United States Patent [19]

Grün et al.

[11] 4,271,569

[45] Jun. 9, 1981

[54] TENTER APPARATUS FOR FABRIC WEB TENTER MACHINES

[75] Inventors: Reinhold Grün, Rudersberg-Oberndorf; Dietrich Troster, Weil der Stadt; Bruno Gleich, Wendlingen, all of Fed. Rep. of Germany

[73] Assignee: Bruckner-Trockentechnik KG, Leonberg, Fed. Rep. of Germany

[21] Appl. No.: 927,378

[22] Filed: Jul. 24, 1978

[30] Foreign Application Priority Data

Aug. 17, 1977 [DE] Fed. Rep. of Germany ..... 2737091

[51] Int. Cl.[3] ..... D06C 3/10

[52] U.S. Cl. ..... 26/79; 26/95

[58] Field of Search ..... 26/79, 93, 94, 95

[56] References Cited

U.S. PATENT DOCUMENTS

| | | | |
|---|---|---|---|
| 404,314 | 5/1889 | Smith | 26/79 |
| 2,201,000 | 5/1940 | Slagboom | 26/79 |
| 2,799,913 | 7/1957 | Mohring et al. | 26/79 X |
| 2,968,084 | 1/1961 | Mohring | 26/79 X |

FOREIGN PATENT DOCUMENTS

| | | | |
|---|---|---|---|
| 135128 | 10/1902 | Fed. Rep. of Germany | 26/79 |
| 156860 | 12/1904 | Fed. Rep. of Germany | 26/79 |
| 921082 | 12/1954 | Fed. Rep. of Germany | 26/79 |
| 14209 | of 1895 | United Kingdom | 26/79 |
| 793 | of 1900 | United Kingdom | 26/79 |
| 895 | of 1903 | United Kingdom | 26/79 |
| 104911 | 3/1917 | United Kingdom | 26/79 |
| 149378 | 8/1920 | United Kingdom | 26/79 |
| 182174 | 6/1922 | United Kingdom | 26/79 |

*Primary Examiner*—Robert Mackey

*Attorney, Agent, or Firm*—Learman & McCulloch

[57] ABSTRACT

Tenter apparatus for fabric web tenter machines comprises a hook body carried by a circulating conveyor, a tenter table fixedly connected to the hook body and serving as support for the fabric web edge, and a hook flap pivotally mounted on the hook body and biased towards the tenter table, such flap carrying a clamping strip directed towards the tenter table for firmly holding a fabric web edge and at least one other clamp member which is disposed spaced from the clamping strip on the side thereof remote from the fabric web and for which a corresponding recess is provided in the tenter table.

6 Claims, 4 Drawing Figures

TENTER APPARATUS FOR FABRIC WEB TENTER MACHINES

In fabric web machinery, tenter hooks generally are employed where only a substantially constant narrow edge region of the fabric web to be tentered is engaged and held by the hook, i.e., between the clamping strip thereof (on the hook flap) and the tenter table. To enable the corresponding fabric web edge to be engaged in the desired manner, a tenter member is provided on the hook flap so that on pivoting of the hook flap in the direction towards the tenter table it comes to bear on the top of the fabric web edge facing such member and initially extending somewhat deeper into the jaw-like tenter hook so that due to this supporting of the tenter member on the fabric web edge, the clamping strip also carried by the hook flap cannot come into engagement with the fabric web edge. Only on occurrence of a transverse tension is the fabric web edge pulled from beneath the tenter member so that the tenter member then drops into the associated recess in the tenter table and the clamping strip thereby engages the fabric web edge and secures the latter; for this purpose the tenter member and the clamping strip must be arranged at a suitable distance apart and from the surface of the tenter table.

The hook flap is furthermore pivotally suspended on the hook body in such manner that when the fabric web is subjected to transverse tension, the clamping strip carried by the flap and usually formed in blade-like manner penetrates deeper into the thickness of the fabric web and in this manner holds the edge thereof still more firmly. In the case of particularly high tensions in the transverse direction of the web (in particular with heavy fabrics and coated material webs), it may however happen that the tenter hook, together with the clamping strip carried thereby, is pulled through outwardly by the web of material or fabric, pulling the previously secured web edge out of the hook and in most cases even shearing off such edge.

The objective of the invention is to improve a tenter hook of the aforementioned type so that with relatively simple means a reliable securing of the tentered material web edge is ensured.

According to the invention, this objective is achieved in that adjacent the tenter member a support member is provided which, on excessive clamping movement of the clamping strip, bears on the surface of the tenter table, and the distance of which from the tenter table surface in the raised state of the hook flap is somewhat greater than the distance of the tenter member from such surface, whereas when the fabric web edge is tentered, the distance of the support member from the tenter table surface is smaller than that of the clamping strip.

To tenter a material web edge in the tenter hook according to the invention, the same procedure is adopted initially as explained above in conjunction with the known construction, i.e., the tenter member bears initially on the top of the web edge engaging somewhat further into the hook and the clamping bar or strip remains raised from the web edge until, after occurrence of a transverse tension from the web, the web edge is pulled from beneath the tenter member and such member has dropped into the associated recess in the tenter table with its lower end, whereupon the clamping strip then engages and secures the web edge. If, however, in this case a correspondingly high transverse tension occurs in the fabric web, due to the construction and arrangement (adjacent the tenter member on the hook flap) according to the invention, the clamping strip carried by the hook flap can firstly, as in the known construction described above, engage somewhat more strongly the fabric web edge and thus increase its holding force; however, this stronger engagement of the clamping strip and the web edge is only possible to a certain extent because when an excessive clamping movement of such clamping strip occurs, the support member provided comes to bear on the surface of the tenter table and a further pivotal movement of the hook flap and thus a further clamping movement of the clamping strip is reliably prevented. In this manner, with the tenter hook construction according to the invention, the hook flap cannot be pulled through towards the fabric web on occurrence of a correspondingly large transverse tension from such web, thus avoiding the disadvantages which this involves; as a result the tentered web edge is always reliably held in a manner which does not damage it.

According to a preferred embodiment of the invention, for the tenter member and support member a single roller is provided which as the tenter roller section comprises at least one longitudinal portion of relatively large diameter and as the support roller section comprises at least one longitudinal portion of smaller diameter.

Such a roller may advantageously be constructed so that the center longitudinal portion of the roller forms the support roller section and as the tenter roller sections two disc-like end portions of the roller of larger diameter are provided which can come into engagement with corresponding slots in the tenter table. Such a combined tenter-support roller can be made very simply and is extremely reliable in operation.

The tenter hook according to the invention may be made as a pure hook or alternatively combined with a needle strip or the like intended for selective securing of fabric web edges and mounted on a needle strip support pivotal upwardly and downwardly.

Hereinafter the invention will be described in detail with reference to a preferred embodiment illustrated in the drawings, wherein.

Figure 1:
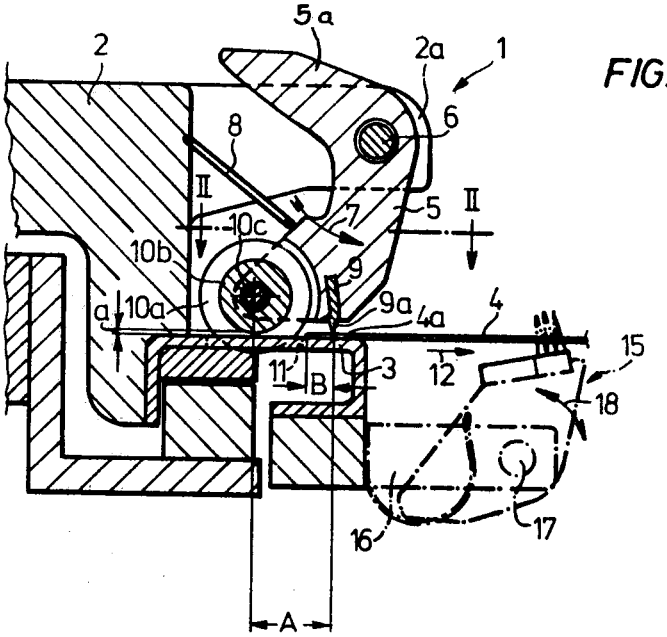
FIG. 1 is a partial cross-section (on line I—I of FIG. 2) through the tenter hook according to the invention.

The construction of the tenter hook according to the invention will first be explained with reference to FIGS. 1 and 2.

The tenter hook 1 is intended for use with fabric or material web tenter machines. In such machines, a plurality of such tenter hooks 1 are carried by a circulating conveying means which is of no interest in the present context and is therefore not illustrated, but which may be an endlessly circulating roller chain or an endlessly circulating cable or the like, as known.

The tenter hook 1 includes a hook body 2 with which it is secured on the circulating conveying means, a tenter table 3 fixedly connected to the hook body 2 and serving as support for the edge 4*a* of the web 4 to be tentered, and a hook flap 5 which is held by a part 2*a* of the hook body 2 projecting in spaced relationship above the table 3. The flap 5 is pivotally mounted on a pin 6 and is movable in the direction of the arrow 7 due to its weight along so that it tends to fall against the table 3. However, in the embodiment illustrated the hook flap 5 is additionally biased in the direction towards the table 3, (i.e. in the direction of the arrow 7) by a tension spring disposed between the hook body 2 and the hook flap 5, which may be a bow tension spring 8, as illustrated, or a helical compression spring or the like.

The hook flap 5 carries at its lower end a clamping strip 9 whose lower edge 9*a*, engageable with the fabric web edge 4*a*, may be made in the form of a blade edge and is inserted into the flap 5 from below. Furthermore, the flap carries at its lower end a clamp roller 10 which is rotatably mounted. The roller 10 is spaced from the clamping strip 9 on the side of the clamping strip remote from the web 4 (cf. FIG. 1).

Of particular significance to the tenter hook according to the invention is the construction and arrangement of the clamp roller 10. This roller 10 includes a tenter roller section 10*a* having at least one longitudinal portion of relatively large diameter and a support roller section 10*b* having at least one longitudinal portion of smaller diameter. In the embodiment illustrated (cf. especially FIG. 2), the cylindrical center longitudinal portion of the roller 10 is constructed as support roller hub 10*b* whilst as tenter roller sections 10*a* two disc-like end flanges of the roller 10 of larger diameter are provided. These disc-like tenter roller flanges 10*a* have associated therewith in the tenter table 3, in each case, a correspondingly formed slot 11, 11*a* in which the bottom parts of the tenter roller flanges 10*a* engage when the web edge 4*a* is correctly tentered, i.e., clamped between the top of the tenter table 3 and the blade edge 9*a* of the clamping strip 9 (cf. FIG. 1).

Figure 2:
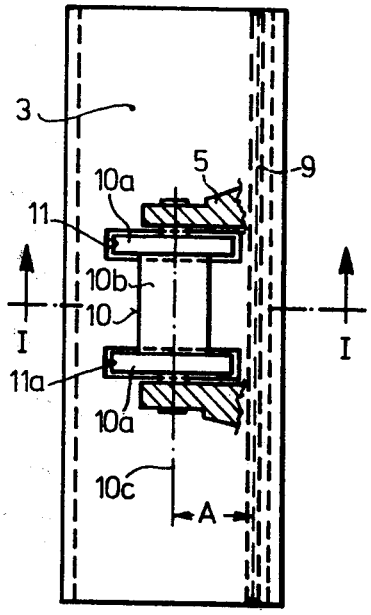
FIG. 2 is a sectional view along the line II—II of FIG. 1.

In this normal operating position of the flap 5 illustrated in FIG. 1, the support roller hub 10*b* has a clearance a from the surface of the tenter table 3 which, by the choice of diameter of the support roller hub 10*b*, is so selected that it is smaller than the clearance between the blade edge 9*a* of the clamping strip 9 and the tenter table surface. The level of the roller hub 10*b* thus is between the levels of the blade edge 9*a* and the roller sections 10*a*. When a greater transverse tension occurs (arrow 12) from the web 4, the clamping strip (with its blade edge 9*a*) can penetrate somewhat further into the web but excessive clamping movement of said clamping strip 9 towards the tenter table surface is prevented by the support roller section 10*b* then bearing on the surface of the tenter table 3 (in the region between the slots 11 and 11*a*). The hub 10*b* thus functions to limit movement of the flap in the direction of the arrow 7. Consequently, the web edge 4*a* cannot be severed by the blade edge 9*a* from the rest of the fabric web 4.

The clearance a between the support roller section 10*b* and the tenter table surface depends generally on the thickness of the web to be tentered; in general, this distance a represents about 0.25 to 0.75 of the thickness of the tentered web. This value simultaneously determines the amount by which the blade edge 9*a* can penetrate into the tentered web 4 (i.e., when the support roller hub 10*b* rests on the table 3) without the web edge being severed from the rest of the web.

Regarding the remainder of the construction and arrangement of the roller 10, the axis 10*c* of the roller 10 lies substantially parallel to the clamping strip 9 and its blade edge 9*a* (the clamping strip 9 in turn lying substantially parallel to the general conveying direction of the web 4, i.e., perpendicular to the plane of the drawing in FIG. 1), and the distance A between the blade edge 9*a* of the clamping strip 9 and the roller axis 10*c* is chosen so that the clamping strip blade edge 9*a* engages the web the desired amount B (FIG. 1) from the outer web longitudinal edge towards the center of the web.

The function of the tenter hook 1 according to the invention will be explained hereinafter with reference to FIGS. 1, 3, and 4:

For clarification, it is first assumed that the flap 5 of the hook 1 is raised in the clamping region of the tenter machine against the action of its own weight and the pressure spring 8, which may, for example, be done with the aid of a stationary guide member not illustrated in detail which engages beneath the lever-like upper end 5*a* of the flap 5 when the hook 1 is led past such guide member. In this manner, the flap 5 is raised in the clamping region of the tenter machine oppositely to the direction of the arrow 7 so that the fabric web edge 4*a* to be tentered can be introduced into the opening formed between the table 3 and the bottom of the flap 5 or the members 9 and 10 carried thereby.

Figure 3:
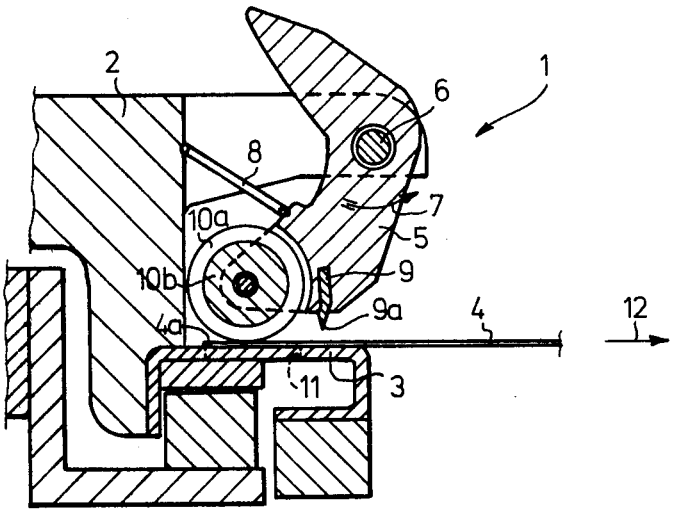
FIGS. 3 and 4 are sectional views similar to FIG. 1 but in different operating positions of the tenter hook and the parts carried thereby.

In the operating position of the tenter hook 1 illustrated in FIG. 3, the hook flap 5 has moved under its own weight and the biasing of the spring 8 in the direction of the arrow 7 against the web 4 or table 3 to such an extent that the tenter roller flanges 10*a* (here constituting first clamp means) of the roller 10 bear on the top of the web 4 but due to the presence of the web edge 4*a* in this region cannot drop into the associated slots 11 and 11*a* in the table 3. As a result, due to the diameter selected for the tenter roller flanges 10*a*, the clamping strip 9 remains with its blade edge 9*a* lifted off the web 4.

When a transverse tension is exerted in the direction of the arrow 12 on the web 4 (due to the weight of the web or a tightening thereof), the outer web edge 4*a* is pulled from beneath the tenter roller flanges 10*a* so that the latter drop with their lower portions into the associated slots 11, 11*a* in the table 3 in the manner illustrated in FIG. 1 to such an extent that in this normal operating condition the blade edge 9*a* of the clamping strip 9 (here constituting second clamp means) engages the top of the web edge 4*a* and secures the latter, the support roller hub 10*b* of the roller 10 still however being spaced from the table surface by the clearance a referred to above.

Figure 4:
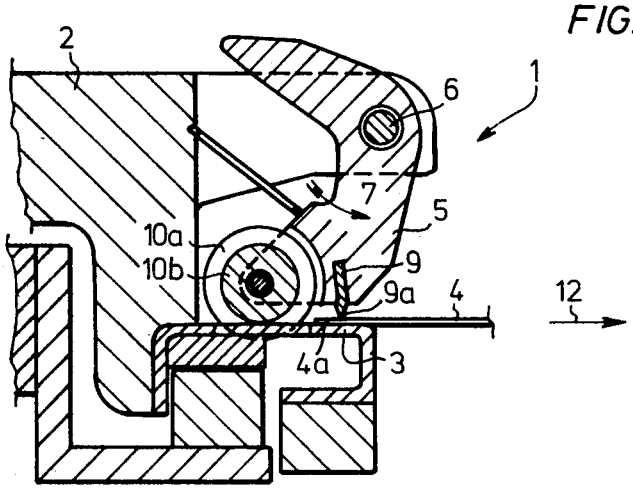

In the position of FIG. 4, the web 4 exerts a particularly high tension force in the direction of the arrow 12 (i.e., in the transverse direction of the web) so that the roller 10 and the clamping strip 9 have been moved still further towards the table 3 compared with the position of FIG. 1 due to the clamping engagement of the strip blade edge 9*a*. The support roller hub 10*b* then bears directly on the surface of the tenter table 3 and thus limits the clamping movement of the strip 9 or flap 5 in the direction of the arrow 7; the blade edge 9*a* has reached its maximum penetration position into the web edge 4*a*; as a result, firstly the web edge 4*a* is reliably secured and secondly severing of said edge 4*a* from the remainder of the web 4 is avoided.

Further indicated in FIG. 1 by dot-dash lines is how the hook 1 according to the invention may be combined, for example, with another member for securing a fabric web edge. In this case, a needle bar 15 is indicated in front of the table 3 and is mounted on a support 16 for upward and downward movement, such support also being carried by the hook body 2. To enable the edge of a material web to be clamped selectively in the tenter hook or the needle bar 15, the latter is correspondingly pivoted upwardly or downwardly in the direction of the double arrow 18 about a pin 17.

We claim:

1. In tenter apparatus having a support provided with a surface at a level to support one edge of a fabric web, a body having one end thereof confronting said support surface and pivotally mounted between its ends for movement of said one end toward and away from said surface, a first clamp fixed to said body adjacent said one end of said body and comprising a rotary roller having relatively large diameter flanges joined by a relatively small diameter hub, a second clamp fixed to said body adjacent said one end and in fixed spaced relation to said first clamp, the relative positions of said first and second clamps being such that movement of said one end of said body toward said support is operable to effect positioning of said flanges at the level of said surface while said hub and said second clamp are spaced from such level, and said support having openings into which said flanges are movable to pass through the level of said surface in response to continued movement of said one end of said body toward said support, the improvement wherein said hub of said first clamp is engageable with said support to terminate movement of said one end of said body toward said support following movement of said flanges into said openings and through the level of said surface, and wherein the diameter of said hub is so related to the spacing between said first and second clamps that when movement of said one end of said body toward said support is terminated by engagement between said hub and said support surface said second clamp is adjacent but spaced from the level of said surface a minimum distance which is less than the thickness of said fabric web, thereby to limit the clamping force said second clamp may apply on said web.

2. Apparatus according to claim 1 including means biasing said body to move said one end toward said surface.

3. Apparatus according to claim 1 wherein the clearance between said second clamp means and said support when said body is in said second position corresponds to about 0.25 to 0.75 of the thickness of such web.

4. Apparatus according to claim 1 wherein said second clamp means comprises an elongate blade.

5. Apparatus according to claim 4 wherein said blade has an edge thereof confronting said support.

6. Apparatus according to claim 1 including a bar having web engageable needles mounted thereon, and means mounting said bar on said support for movements into and out of a position in which said needles are engageable with said web.

* * * * *